US005266015A

United States Patent [19]

Gannaway

[11] Patent Number: 5,266,015

[45] Date of Patent: Nov. 30, 1993

[54] COMPRESSOR SUCTION AND DISCHARGE VALVE ASSEMBLY

[75] Inventor: Edwin L. Gannaway, Adrian, Mich.

[73] Assignee: Tecumseh Products Company, Tecumseh, Mich.

[21] Appl. No.: 835,204

[22] Filed: Feb. 13, 1992

[51] Int. Cl.[5] ..... F04B 39/10

[52] U.S. Cl. ..... 417/550; 417/564; 417/570; 137/854

[58] Field of Search ..... 137/854; 417/550, 564, 417/570, 569; 42/240, 175; 123/663, 671

[56] References Cited

U.S. PATENT DOCUMENTS

| | | | |
|---|---|---|---|
| 2,955,749 | 10/1960 | Tomkowiak | 417/564 |
| 3,061,176 | 10/1962 | Nicholas et al. | 417/295 |
| 3,204,865 | 9/1965 | Neubauer | 417/255 |
| 3,807,910 | 4/1974 | Paget | 417/564 |
| 4,565,507 | 1/1986 | Reimers | 417/564 |
| 4,834,632 | 5/1989 | Gatecliff | 417/570 |

FOREIGN PATENT DOCUMENTS

| | | |
|---|---|---|
| 58-2481 | 6/1981 | Japan . |
| 58-10176 | 7/1981 | Japan . |

*Primary Examiner*—Richard A. Bertsch
*Assistant Examiner*—Roland McAndrews
*Attorney, Agent, or Firm*—Baker & Daniels

[57] ABSTRACT

A compressor assembly is disclosed including a compressor mechanism mounted within a hermetically sealed housing. A cylinder block contains a reciprocating piston in which the piston includes a suction valve assembly and an annular rim that substantially completely fills the discharge port when the piston is at top dead center position, to reduce re-expansion volume. The cylinder head assembly is attached directly to the cylinder block with no intermediate gasket therebetween, permitting coplanar seating of the discharge valve with a correspondingly larger discharge valve seat perimeter permitting faster valve closure and lower pressure loss through the discharge port.

13 Claims, 3 Drawing Sheets

COMPRESSOR SUCTION AND DISCHARGE VALVE ASSEMBLY

BACKGROUND OF THE INVENTION

The present invention relates generally to a hermetic compressor and, more particularly, to a compressor having a reciprocating piston including a suction valve assembly and a discharge valve assembly.

The general prior art of hermetic compressors comprise a hermetically sealed housing having a compressor mechanism mounted therein. The compressor mechanism may include a crankcase or a cylinder block defining a compression chamber therein in which gaseous refrigerant is compressed and subsequently discharged.

A disadvantage to prior compressor designs is that there is always a certain volume left in the cylinder when the piston is at top dead center position. This volume of gas never leaves the cylinder but is repetitively compressed and re-expanded during the reciprocation of the piston. Re-expansion volume causes a major loss of energy in a compressor.

Another disadvantage of prior compressor valve designs is that at high compression ratios, the discharge valves are noisy and do not close fast enough for efficient operation. Small discharge valve ports in these compressors require a large discharge valve lift for operation. The larger the amount of valve lift the slower the valve closure, since the valve has to travel a longer distance to close. Slow closing valves permit leakage back into the compression space during operation thereby lowering the compressor's efficiency.

Small discharge ports also create a large pressure drop in the compressed fluid as it travels through the ports. This pressure drop lowers the volumetric efficiency of the compressor.

SUMMARY OF THE INVENTION

The present invention overcomes the aforementioned problems associated with prior art compressors by providing a suction valve assembly with an annular rim on the piston to interfit with a discharge port thereby reducing re-expansion volume. The discharge port includes an enlarged discharge valve perimeter for reducing discharge valve lift thereby increasing the discharge valve closure speed and lowering the pressure drop through the discharge port.

Generally, the invention provides a piston reciprocating within a cylinder block. On the piston is mounted a suction valve assembly. An annular rim on the piston fits into an annular discharge port during reciprocation of the piston thereby reducing the re-expansion volume within the discharge port.

In one form of the invention, the cylinder head assembly is attached directly to the cylinder block. There is no intermediate conventional valve plate between the cylinder head and cylinder block. A valve seat plate is attached to the cylinder head assembly and interfits within the cylinder bore to provide one side of a discharge valve seat. The discharge valve attached to the cylinder head assembly coplanarly seats with both the edge of the cylinder block around the cylinder bore and the valve seat plate. Coplanar seating of the discharge valve occurs when the discharge valve covers the discharge port by seating against the cylinder block and the valve seat plate. This co-planar seating permits a large discharge valve area. No head gasket is used in this invention since the gasket would not permit the coplanar seating of the discharge valve on the cylinder block needed for efficient operation.

An advantage of the compressor of the present invention is that no conventional valve plate is required thereby allowing coplanar seating of the discharge valve against the cylinder block. This provision of the discharge valve seating against the cylinder block allows a large seat perimeter permitting the discharge valves to operate with a smaller valve lift. Small valve lift permits the valve to operate at a faster rate with low gas velocities since there is less valve travel. Faster valve closure increases the pumping rate and compressor efficiency at high compression ratios. The enlarged area of the discharge valve also reduces the pressure drop through the discharge port.

Another advantage of the compressor of the present invention is of reducing the re-expansion volume by the annular rim substantially completely occupying the discharge port when the piston is at top dead center. By reducing the re-expansion volume, less work is wasted by the compressor, thereby increasing its efficiency.

Yet another advantage of the compressor of the present invention is that there is no head gasket required intermediate the cylinder block and the cylinder head assembly. This design reduces the number of parts in the compressor while also allowing coplanar seating of the discharge valve to the cylinder block.

The various features discussed above all combine to result in a hermetic compressor which runs quietly and smoothly with extreme efficiency.

The invention, in one form thereof, provides a compressor including a cylinder block and cylinder head assembly defining an annular discharge port with a discharge valve mounted to the cylinder head assembly over the discharge port. A piston is disposed within the cylinder block, the piston having a front surface and rear surface with a suction port extending through the piston from the front to the rear surface. A suction valve assembly is attached to the piston over the suction port. Drive means for reciprocating the piston within the cylinder block is also included. Re-expansion volume is reduced by the inclusion of an annular rim on the piston that substantially completely occupies the discharge port when the piston is at top dead center within the cylinder block.

The present invention, in one form thereof, provides a compressor including a cylinder block having a cylinder bore with the bore containing a piston. Drive means are included on the compressor for reciprocating the piston within the cylinder bore. A cylinder head assembly including a cylinder head with an attached discharge valve assembly having a valve seat plate and a discharge valve is included with the discharge valve disposed between the valve seat plate and cylinder head. The discharge valve seats against the cylinder block and the valve seat plate on the suction stroke of the piston. The cylinder head assembly is attached to the cylinder block with the valve seat plate forming an annular discharge port with the cylinder block. The cylinder block and cylinder head assembly are attached together without an intermediate head gasket thereby allowing coplanar seating of the discharge valve between the spacer block and the discharge valve assembly.

The present invention, in one form thereof, provides a compressor including a cylinder block having a cylinder bore, with the cylinder bore having an inner peripheral wall and a piston reciprocating within the cylinder bore. A cylinder head assembly attached directly to the cylinder block over the cylinder bore includes a discharge valve attached to a protruding portion having an outer peripheral surface thereby creating an annular discharge port in the cylinder bore between the inner peripheral wall and the outer peripheral surface. The discharge valve seats against the cylinder block whereby the discharge valve seats coplanarly with the cylinder block and the protruding portion.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
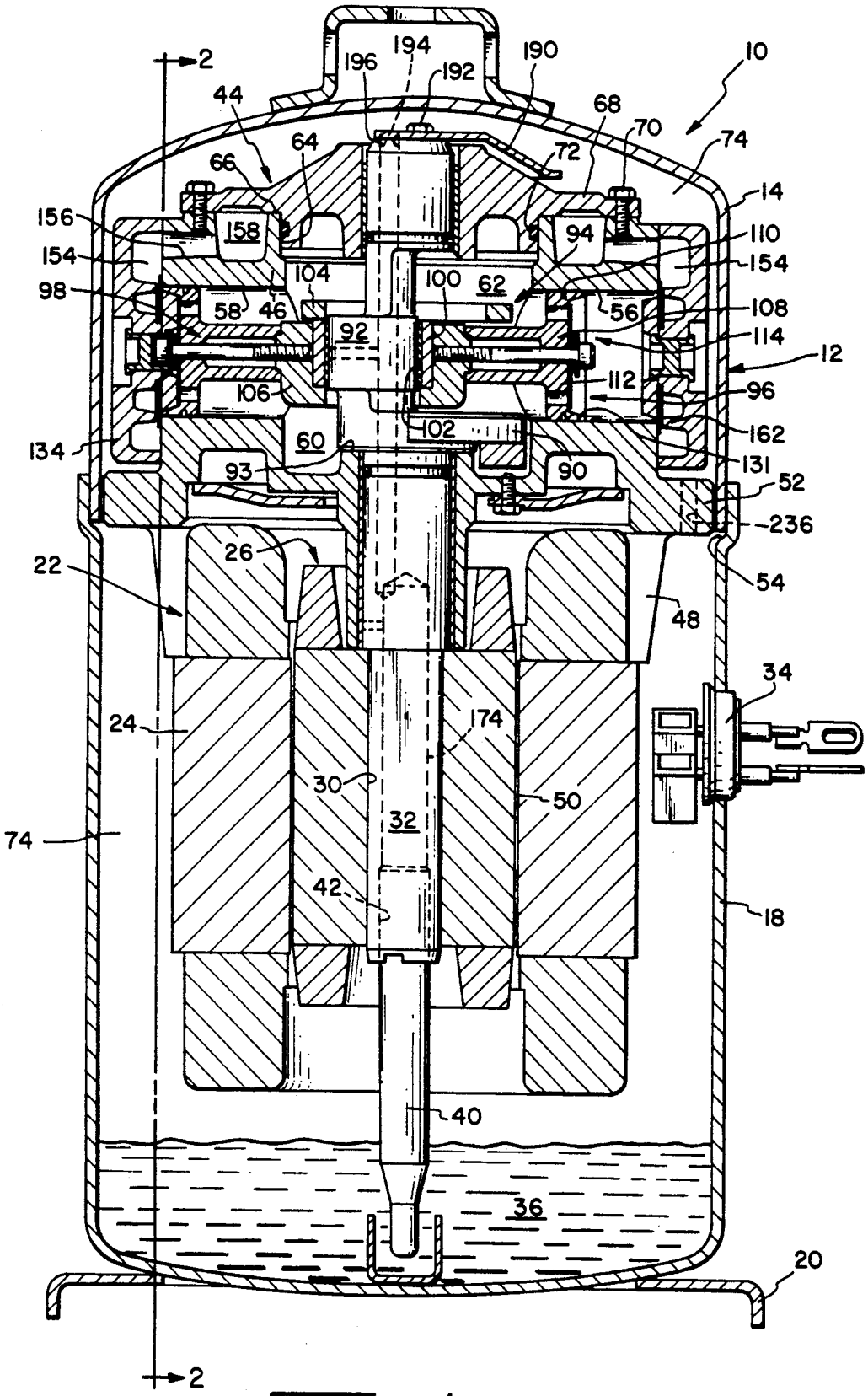
FIG. 1 is a longitudinal sectional view of a compressor incorporating the present invention.

Corresponding reference characters indicate corresponding parts throughout the several views. The exemplifications set out herein illustrate a preferred embodiment of the invention, in one form thereof, and such exemplifications are not to be construed as limiting the scope of the invention in any manner.

DESCRIPTION OF THE PREFERRED EMBODIMENT

In an exemplary embodiment of the invention as shown in the drawings, and in particular by referring to FIG. 1, a compressor assembly 10 is shown having a housing generally designated at 12. The housing has a top portion 14 and a bottom portion 18. The two housing portions are hermetically secured together as by welding or brazing. A mounting flange 20 is welded to the bottom portion 18 for mounting the compressor in a vertically upright position. Located within hermetically sealed housing 12 is an electric motor generally designated at 22 having a stator 24 and a rotor 26. The stator is provided with windings 28. Rotor 26 has a central aperture 30 provided therein into which is secured a crankshaft 32 by an interference fit. A terminal cluster 34 is provided in bottom portion 18 or housing 12 for connecting the compressor to a source of electric power.

Compressor assembly 10 also includes an oil sump 36 located in bottom portion 18. A centrifugal oil pick-up tube 40 is press fit into a counterbore 42 in the end of crankshaft 32. Oil pick-up tube 40 is of conventional construction and includes a vertical paddle (not shown) enclosed therein.

Also enclosed within housing 12, in the embodiment shown in FIG. 1, is a scotch yoke compressor mechanism generally designated at 44. A complete description of a basic scotch yoke compressor design is given in U.S. Pat. No. 4,838,769 assigned to the assignee of the present invention and expressly incorporated by reference herein.

Compressor mechanism 44 comprises a crankcase or cylinder block 46 including a plurality of mounting lugs 48 to which motor stator 24 is attached such that there is an annular air gap 50 between stator 24 and rotor 26. Crankcase 46 also includes a circumferential mounting flange 52 axially supported within an annular ledge 54 in central portion 18 of the housing. The lower portion of crankcase 46 and mounting flange 52 serve to divide the interior of the housing 12 into an upper chamber in which the compressor mechanism 44 is mounted and a lower chamber in which motor 22 is disposed. A passage 236 extends through flange 52 to provide communication between the top and bottom ends of housing 12 for return of lubricating oil and equalization of discharge pressure within the entire housing interior.

Compressor mechanism 44, as illustrated in the preferred embodiment, takes the form of a reciprocating piston, scotch yoke compressor. More specifically, crankcase 46 includes four radially disposed cylinders, two of which are shown in FIG. 1 and designated as cylinder 56 and cylinder 58. The four radially disposed cylinders open into and communicate with a central suction cavity 60 defined by inside cylindrical wall 62 in crankcase 46. A relatively large pilot hole 64 is provided in a top surface 66 of crankcase 46. Various compressor components, including the crankshaft, are assembled through pilot hole 64. A top cover such as cage bearing 68 is mounted to the top surface of crankcase 46 by means of a plurality of bolts 70 extending through bearing 68 into top surface 66. When bearing 68 is assembled to crankcase 46, and O-ring seal 72 isolates suction cavity 60 from a discharge pressure space 74 defined by the interior of housing 12.

Crankshaft 32 is rotatably journalled in crankcase 46, and extends through a suction cavity 60. Crankshaft 32 includes a counterweight portion 90 and an eccentric portion 92 located opposite one another with respect to the central axis of rotation of crankshaft 32 to thereby counterbalance one another. The weight of crankshaft 32 and rotor 26 is supported on thrust surface 93 of crankcase 46.

Eccentric portion 92 is operably coupled by means of a scotch yoke mechanism 94 to a plurality of reciprocating piston assemblies corresponding to, and operably disposed within, the four radially disposed cylinders in crankcase 46. As illustrated in FIG. 1, piston assemblies 96 and 98, representative of four radially disposed piston assemblies operable in compressor assembly 10, are associated with cylinder bores 56 and 58, respectively.

Scotch yoke mechanism 94 comprises a slide block 100 including a cylindrical bore 102 in which eccentric portion 92 is journalled. Scotch yoke mechanism 94 also includes a pair of yoke members 104 and 106 which cooperate with slide block 100 to convert orbiting motion of eccentric portion 92 to reciprocating movement of the four radially disposed piston assemblies. For instance, FIG. 1 shows yoke member 106 coupled to piston assemblies 96 and 98 of the present invention, whereby when piston assembly 96 is at a bottom dead center position, piston assembly 98 will be at a top dead center position.

A counterweight 190 is attached to the top of shaft 32 by means of an off-center mounting bolt 192. An extruded hole 194 through counterweight 190 aligns with axial oil passageway 174, which opens on the top of crankshaft 32 to provide an outlet for oil pumped from sump 36. An extruded portion 196 of counterweight 190 extends slightly into passageway 174 which, together with bolt 192, properly aligns counterweight 190 with respect to eccentric portion 92.

Referring once again to piston assemblies 96 and 98 of the present invention, each piston assembly comprises a piston member 108 to reciprocate within a cylinder bore to compress gaseous refrigerant therein. Piston member 108 includes an annular piston ring 110. Suction ports 112 extending through piston member 108 from a front surface 118 to a rear surface 119 allow suction gas within suction cavity 60 to enter cylinder 56 on the compression side of piston 108.

A suction valve assembly 114 is associated with each piston assembly, and will now be described with respect to piston assembly 96 shown in FIG. 3. Suction valve assembly 114 comprises a flat, disk-shaped suction valve 116 which in its closed position covers suction ports 112 on a top surface 118 of piston member 108. Suction valve 116 open and closes by virtue of its own inertia as piston assembly 96 reciprocates in cylinder 56. More specifically, suction valve 116 rides along a cylindrical guide member 120 and is limited in its travel to an open position by a flexible annular valve retainer 122.

Figure 3:
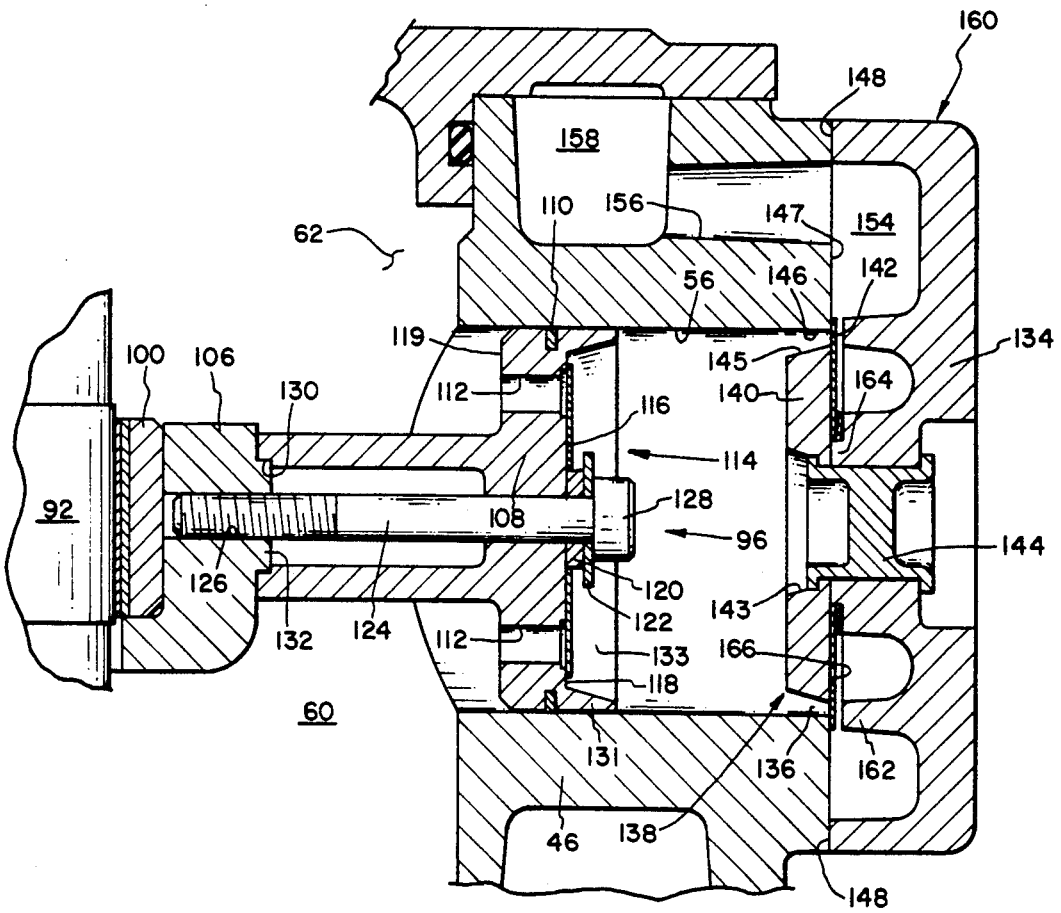
FIG. 3 is an enlarged sectional view of the cylinder block and cylinder head assembly of FIG. 1, particularly showing the suction and discharge valve assemblies.

As illustrated in FIG. 3, a valve retainer 122, suction valve 116, and guide member 120 are secured to top or front surface 118 of piston member 108 by a threaded bolt 124 having a buttonhead 128. Threaded bolt 124 is received within a threaded hole 126 in yoke member 106 to secure piston assembly 96 thereto. As shown with respect to the attachment of piston assembly 98 to yoke member 106, an annular recess 130 is provided on the corresponding yoke member, whereby boss 132 is received within recess 130 to promote positive, aligned engagement therebetween.

On top surface 118 of piston member 108 is an annular rim in accordance with one form of the present invention, such as circular rim 131, which substantially completely occupies annular discharge port 136 when piston assembly 96 is at top dead center position. Circular rim 131 interfits with discharge port 136 to reduce the re-expansion volume of cylinder bore 56 and reduce the power consumption of compressor 10. Preferably circular rim 131 lies on the outer diameter of piston member 108 to create the largest discharge valve perimeter possible. Circular rim 131 creates a recessed space 133 in which suction valve assembly 114 is located. Recessed space 133 permits piston member 108 to engage discharge valve seat plate 140. By having the suction assembly 114 on piston member 108 along with circular rim 131, substantially all of the re-expansion volume within each cylinder is eliminated.

Cylinder head assembly 160 includes cylinder head 134 having a number of web portions 162 that function as valve retainers for discharge valve 142. Head assembly 160 also provides a central hub portion 164 to which attaches discharge valve assembly 138.

Discharge valve assembly 138, as shown in FIG. 3, includes a protruding portion or valve seat plate 140 and a flat annular discharge valve 142 attached to central hub portion 164 by means of a rivet 144. Discharge valve 142 is disposed intermediate valve seat plate 140 and cylinder head 134. Valve seat plate 140 is centered within and has a smaller diameter than cylinder bore 56. Valve seat plate 140 includes an outer peripheral wall 145 that defines the inner side of annular discharge port 136. Inner peripheral wall 146 of cylinder bore 56 defines the outer side of discharge port 136. Valve seat plate 140 also includes a counterbored portion 143 to accommodate rivet 144. Counterbored portion 143 of valve seat plate 140 accommodates piston bolt buttonhead 128 when piston assembly 96 is at top dead center position.

Top surface 166 of valve seat plate 140 is adjacent discharge valve 142 to permit coplanar seating. Coplanar seating is accomplished by discharge valve 142 sealing flat against top surface 166 of valve seat plate 140 and attaching surface 147 of cylinder block 46. This coplanar seating permits faster valve operation and longer valve life.

The present construction permits circular rim 131 on piston assembly 96 to interfit within discharge port 136 and reduce re-expansion volume. Annular discharge port 136 is larger than conventional discharge ports because there is no conventional valve plate and the port has a circumference equal to that of cylinder bore 56. Cylinder head assembly 160 together with cylinder block 46 define discharge port 136. Enlarged discharge port 136 reduces the pressure drop through the port thereby providing a higher volumetric efficiency with lower power consumption.

Discharge valve 142 coplanarly seats against adapter plate 140 and cylinder block 46. Attaching surface 147 above cylinder block 46 is finish ground flat, to a high tolerance, to provide a flat seat for discharge valve 142 during the suction stroke of the piston.

Figure 2:
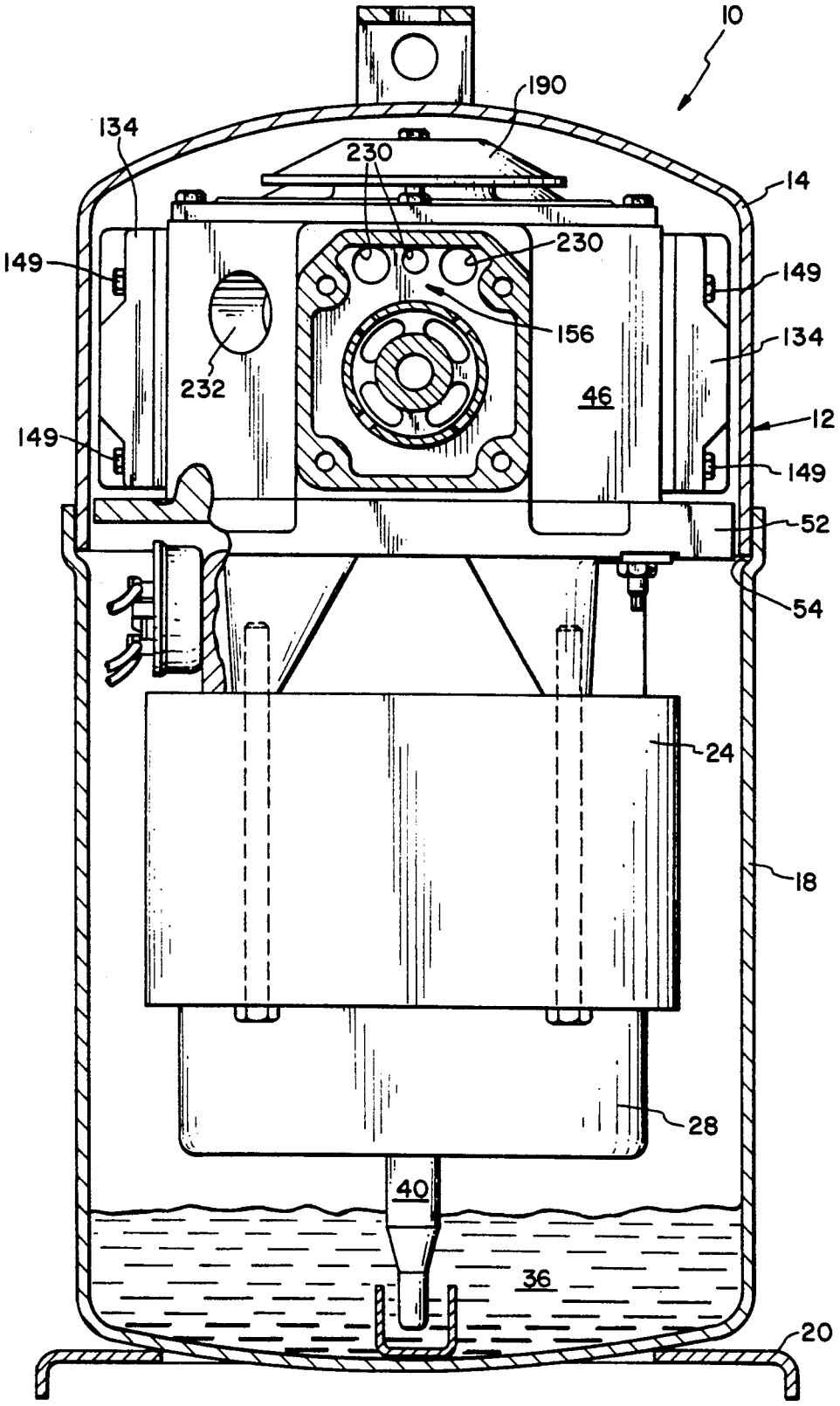
FIG. 2 is a sectional view of the compressor of FIG. 1 taken along line 2—2 in FIG. 1 and viewed in the direction of the arrows.

Cylinder head 134 includes an attachment surface 148 that is finish ground flat. Cylinder head 134 is connected to cylinder block 46 by bolts 149 as shown in FIG. 2. Attaching surface 147 of cylinder block 46 and attachment surface 148 of cylinder head 134 seal together without the need of a gasket because they have a high degree of flatness. The attaching surface 147 and attachment surface 148 are both finish ground. In particular, no head gasket is used since a gasket between cylinder block 150 and cylinder head 134 would prevent the coplanar seating of discharge valve 142. A head gasket would also increase the number of parts of the compressor assembly.

The coplanar seating of discharge valve 142 permits a maximum discharge valve perimeter thereby reducing the discharge valve lift for quieter valves and faster discharge valve closure. Faster discharge valve closure increases the pumping rate and compressor efficiency at high compression ratios. The combination of filling discharge port 136 with circular rim 131 and a large coplanar discharge valve perimeter provide a more efficient compressor at all operating conditions.

Referring now to FIG. 2, an upper portion of compressor mechanism 44 is shown to better illustrate the disclosed valve system. More specifically, FIG. 2 further shows connecting passage 156 of FIG. 1 as comprising a plurality of bores 230, associated with each radially disposed cylinder arrangement, to connect between discharge space 154 within cylinder head cover 134 and top muffling chamber 158. Also shown in FIG. 2 is a suction inlet opening 232 included in crankcase 46, providing communication between the outside of the crankcase and suction cavity 60 defined therein.

In operation, piston assembly 96 will reciprocate within cylinder bore 56. As piston assembly 96 move from bottom dead center position to top dead center position on its compression stroke, suction valve sliding on guide member 120 will slide, by virtue of its inertia, over and close suction port 112. As piston assembly 96 moves toward cylinder head assembly 160, gaseous refrigerant within cylinder bore 56 will be compressed and forced through discharge port 136, past discharge valve 142 through discharge space 154, and out into compressor housing 12.

As piston member 108 reaches top dead center position, circular rim 131 will substantially completely occupy discharge port 136 thereby reducing the re-expansion volume. Suction valve retainer 122 and button head 128 on guide member 120 will interfit counterbored portion 143 of discharge valve assembly 138. Valve seat plate 140 will substantially interfit into recessed space 133 of piston member 108 to further reduce re-expansion volume.

As piston member 108 reaches top dead center position and begins a suction stroke, suction valve 116 will be thrown forward on guide member 120 until it stops at suction valve retainer 122. At this time fluid at suction pressure from central suction cavity 60 will begin to fill cylinder bore 56.

While piston member 108 begins its suction stroke, discharge valve 142 will close sealing discharge port 136. Discharge valve 142 will coplanarly seal against top surface 166 of valve seat plate 140 and the attaching surface 147 of cylinder block 46.

Piston member 108 will proceed to bottom dead center position and reverse direction allowing suction valve 116 to continue forward on guide member 120 and seal suction port 112. The suction stroke is now complete and a compression stroke begins once more.

In an alternative construction of the compressor of the present invention, if it is not possible to finish attaching surface 147 due to the crankcase material utilized, a modified cylinder head gasket may be used.

A counterbored head gasket may be interfit between attaching surface 147 and attachment surface 148. This gasket would contain a counterbored area longer than discharge valve 142 to prevent any restriction to movement of valve 147. Discharge valve 147 will still coplanarly seat against cylinder bock 46 and valve seat plate 140.

It is evident that the valve system described herein is applicable to other types of compressors other than scotch yoke compressors. The new valve system may be utilized in single or double reciprocating piston compressors as well. The present invention would reduce re-expansion and increase discharge valve speed in these compressors.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A compressor comprising:

a cylinder block and cylinder head assembly defining an annular discharge port;

a discharge valve mounted to said cylinder head assembly over said discharge port;

a piston having a front surface and a rear surface, said piston having a suction port extending through said piston from said front surface to said rear surface;

a suction valve assembly attached to said piston over said suction port in said piston;

drive means for reciprocating said piston within said cylinder block; and an annular rim on said piston that substantially completely occupies said discharge port when said piston is at top dead center, said annular rim comprising a circular rim on said piston head, said circular rim in sliding contact with said cylinder block, whereby re-expansion volume is reduced.

2. The compressor of claim 1 in which said rim is tapered radially inwardly toward said suction valve assembly.

3. The compressor of claim 1 in which said suction valve assembly comprises a disk shaped suction valve, a guide member, and a flexible valve retainer, said guide member connecting said piston and said valve retainer, said suction valve sliding on said guide member to seal over said suction port.

4. A compressor comprising:

a cylinder block having a cylinder bore, said bore containing a piston;

drive means for reciprocating said piston within said cylinder bore; and a cylinder head assembly including a cylinder head with an attached discharge valve assembly having a valve seat plate and a discharge valve, said discharge valve disposed between said valve seat plate and said cylinder head, said discharge valve seats against said cylinder block and said valve seat plate on the suction stroke of said piston, said cylinder head assembly attached directly to said cylinder block, said valve seat plate forming an annular discharge port with said cylinder block.

5. The compressor of claim 4 in which said cylinder block and said cylinder head assembly are attached together without an intermediate head gasket, thereby allowing coplanar seating of said discharge valve between said cylinder block and said discharge valve assembly.

6. The compressor of claim 4 in which portions of said cylinder head assembly contact said cylinder block, said portions are finish ground.

7. The compressor of claim 4 in which said cylinder head includes integrally formed web portions located adjacent said discharge valve to retain said discharge valve in a proper location.

8. The compressor of claim 4 further comprising:

said piston including a front surface and rear surface, said piston having an opening extending through said piston from said front surface to said rear surface;

a suction valve assembly on said piston over said opening; and a circular rim on said piston in sliding contact with said cylinder bore, said rim slidable into said discharge port whereby re-expansion volume is reduced.

9. The compressor of claim 8 in which said cylinder block and said cylinder head assembly are attached together without an intermediate head gasket, thereby allowing coplanar seating of said discharge valve between said cylinder block and said discharge valve assembly.

10. A compressor comprising:

a cylinder block having a cylinder bore, said bore having an inner peripheral wall;

a piston reciprocating within said cylinder bore;

a cylinder head assembly attached directly to said cylinder block over said cylinder bore, said assembly including a protruding portion having an outer peripheral surface, and a discharge valve attached to said protruding portion, said assembly creating an annular discharge port in said cylinder bore between said inner peripheral wall and said outer peripheral surface, said discharge valve seating against said cylinder block, whereby said discharge valve seats coplanarly with said cylinder block and said protruding portion.

11. The compressor of claim 10 in which said cylinder head assembly surfaces contacting said cylinder block are finish ground.

12. The compressor of claim 10 in which said cylinder head assembly includes integrally formed web portions located adjacent said discharge valve to retain said discharge valve in a proper location.

13. A compressor comprising:

a cylinder block and cylinder head assembly defining an annular discharge port, said cylinder head assembly including a cylinder head with an attached discharge valve assembly including a valve seat plate and a discharge valve, said discharge valve mounted to said cylinder head assembly over said discharge port, said discharge valve disposed between said valve seat plate and said cylinder head, said discharge valve seats against said cylinder block and said valve seat plate on the suction stroke of said piston, said cylinder head assembly attached directly to said cylinder block, said valve seat plate forming said annular discharge port with said cylinder block;

a piston having a front surface and a rear surface, said piston having a suction port extending through said piston from said front surface to said rear surface;

a suction valve assembly attached to said piston over said suction port in said piston;

drive means for reciprocating said piston within said cylinder block; and an annular rim on said piston that substantially completely occupies said discharge port when said piston is at top dead center, whereby re-expansion volume is reduced.

* * * * *